United States Patent [19]

Krubsack et al.

[11] 4,424,555

[45] Jan. 3, 1984

[54] CONCEALABLE LIGHTING FIXTURE

[75] Inventors: Ronald H. Krubsack, Vernon Hills; Jerome C. Caruso, Lake Forest, both of Ill.; Larry J. Krubsack, Colgate, Wis.

[73] Assignee: Hartland Products Company, Inc., Hartland, Wis.

[21] Appl. No.: 351,015

[22] Filed: Feb. 22, 1982

[51] Int. Cl.[3] ..... F21M 3/18

[52] U.S. Cl. ..... 362/419; 362/127; 362/269; 362/270; 362/285; 362/427; 362/430; 362/431; 248/419

[58] Field of Search ..... 362/86, 127, 130, 431, 362/450, 419, 432, 269, 270, 285, 427, 430

[56] References Cited

U.S. PATENT DOCUMENTS

| | | | |
|---|---|---|---|
| 1,429,433 | 9/1922 | McFaddin . | |
| 1,622,057 | 3/1927 | Senter . | |
| 1,832,492 | 11/1931 | Marchand | 362/801 |
| 1,858,232 | 5/1932 | Piambo . | |
| 2,289,105 | 7/1942 | Doane . | |
| 2,574,211 | 11/1951 | Hill | 362/422 |
| 3,790,770 | 2/1974 | Stern | 362/801 |

*Primary Examiner*—Stephen J. Lechert, Jr.
*Assistant Examiner*—Howard J. Locker
*Attorney, Agent, or Firm*—Merriam, Marshall & Bicknell

[57] ABSTRACT

A concealable lighting fixture wherein the longer, vertically extending leg of a support frame is mounted in a vertically extending bearing in a bracket so that the frame is vertically shiftable in and rotatable with respect to the bracket. A diametrically extending support pin is mounted in the lower end of the longer leg for engaging a support surface on the upper end of the bracket. When engaged with the support surface, the support pin releasably retains the frame, and a lamp assembly on the upper end of the support frame, in an elevated operative position. In one embodiment, the bearing for the longer leg of the frame is provided by concave recesses in the inner faces of a pair of vertically extending flanges on one side of the plate portion of the bracket. In another embodiment, the bearing is provided by a tube welded to the plate portion. A vertical slot in the bearing prevents the support frame from being shifted between its raised and lowered position except when at least one of the ends of the support pin is aligned with the slot. A plurality of vertically spaced guide pins in the longer leg of the frame prevent rotation of the frame as it is being raised or lowered. The lamp assembly includes a shade support member that is pivotally connected to the outer end of a horizontally extending section at the upper end of the support frame, and pins in the inner ends of a pair of horizontally extending tubular shades prevent disengagement of the shades from the shade support member when the pins are engaged in slots in the outer ends of the shade support member.

25 Claims, 15 Drawing Figures

103
104
105
106
107
108
110
112
113
114
116
117
118
120
121
122
124
127
132
133
134
135
136
137
144
145
147
152
44
46
L

CONCEALABLE LIGHTING FIXTURE

BACKGROUND OF THE INVENTION

1. Field of the Invention

This invention relates to lighting fixtures, and more particularly relates to a lighting fixture in which the lamp portion thereof, and its supporting frame, may be raised or lowered so that the fixture is concealed from view when not in use and in which the rotatably adjustable shades of the fixture can be engaged or disengaged therefrom only when in one rotated position.

2. Description of the Prior Art

Various type of lighting fixtures have been heretofore developed which permitted the lamps thereof to be shifted to different positions so that the light emitted from the lamps could be directed to different locations. Examples of lighting fixtures in which the lamps were capable of being raised or lowered with respect to a surface or object to be illuminated, or swung from side to side, are disclosed in the Doane U.S. Pat. No. 2,289,105, Senter U.S. Pat. No. 1,622,057 and McFaddin U.S. Pat. No. 1,429,443. A lamp construction is also disclosed in the Piambo U.S. Pat. No. 1,858,232, wherein the lamp is mounted on the outer end of an extensible and retractable arm, the arm being swingable about a vertical axis.

While the lighting fixtures disclosed in the aforementioned patents permitted the lamps thereof to be shifted to different positions in order to obtain a desired lighting arrangement, the structures employed to effect such movements were complex, frequently unreliable in operation, and expensive. Moreover, because of the types of constructions employed, such fixtures did not permit the lamps to be rapidly and easily shifted between an elevated operative position and a depressed position in which the fixture was concealed by a large musical instrument or article of furniture.

Accordingly, it is a general object of the present invention to provide a novel and improved lighting fixture in which the lamp assembly thereof, and its supporting frame, may be rapidly and easily shifted between an elevated operating position and a depressed, concealed position.

Another object is to provide a novel lighting fixture of the foregoing character, which is particularly adapted to be mounted on a large musical instrument or piece of furniture, or on a vertical wall adjacent thereto, so that the fixture is concealed from view when the lamp is in its depressed position.

Still another object is to provide a novel lighting fixture of the character described, wherein the lamp assembly thereof includes a pair of elongated shades that are mounted on a support member in end-to-end relation so as to be rotatable in opposite directions with respect to the support member in order to control the direction of light emitted from the assembly and wherein the shades are engageable with and removable from the support member of the assembly only when the shades are in a particular rotated position with respect to the support member.

These and other objects will become apparent from the detailed description which follows, and the accompanying sheets of drawings.

SUMMARY OF THE INVENTION

Briefly described, the present invention contemplates a concealable lighting fixture which includes a bracket having a plate portion that is adapted to be mounted on a vertical surface in a concealed location, such as on the rear side of a large musical instrument or item of furniture capable of concealing the fixture. The bracket includes a bearing for receiving, slidably and rotatably supporting an elongated, vertically extending portion or leg of a support frame. The frame also includes a horizontally extending section, one end of which is connected to the upper end of the vertically extending leg, and a lamp assembly is mounted on the end of the horizontal section for pivotal movement about a vertical axis.

In one embodiment, the bearing is defined by concave recesses in the opposed inner surfaces of a pair of laterally spaced, vertically extending flanges on one side of the plate portion of the bracket. In another embodiment, the bearing is provided by a split tube that is welded or otherwise secured to one side of the plate portion. In both embodiments, a horizontal surface on the upper end of the bearing and a horizontally extending support pin mounted in the vertically extending leg of the frame serves to releasably retain the frame and lamp assembly in an elevated operative position while permitting the frame and lamp assembly to be swung through a range of angular positions about a vertical axis through the vertically extending leg.

The frame and lamp assembly are shiftable to a depressed, concealed position behind the musical instrument or item of furniture by swinging the horizontally extending section of the frame to a position where the projecting end or ends of the support pin are aligned with a vertically extending slot in the bearing, and then lowering the frame and lamp assembly to its depressed, concealed position. The vertically extending leg of the frame also includes a plurality of vertically spaced diametrically extending guide pins, the ends of which project outwardly from the leg portion in vertical alignment with the projecting end or ends of the support pin. The guide pins prevent rotation of the frame in the mounting bracket while the frame is being raised or lowered.

The lamp assembly of the fixture is mounted on the outer end of the horizontally extending section of the support frame for pivotal movement about a vertical axis. The assembly includes a tubular, shade supporting member in which one or more sockets are mounted. In one embodiment, a pair of tubular shades are mounted on the shade supporting member, in end-to-end, coaxial relation, and in another embodiment, only one shade is mounted on the shade supporting member. In both embodiments, slot means is formed in one or both ends of the shade support member, such slot means including circumferentially and axially extending portions. The inner end of each axially extending portion intersects one of the circumferentially extending portions and the outer end of each axially extending portion opens in the outer end of the support member. A radially extending pin is provided in the inner end of each shade, the pin serving to retain the shade on the support member when the inner end of the pin is disposed in the circumferentially extending portion of the slot.

Each shade is rotatable to different positions on the support member to control the direction in which light is emitted through an aperture therein. The shade or shades are engageable with and disengageable from the support member by rotating the same to predetermined positions in which the pins are aligned with the axially extending portions of the slot, and then shifting the shade or shades axially onto or off of the support member.

DETAILED DESCRIPTION

Figure 1:
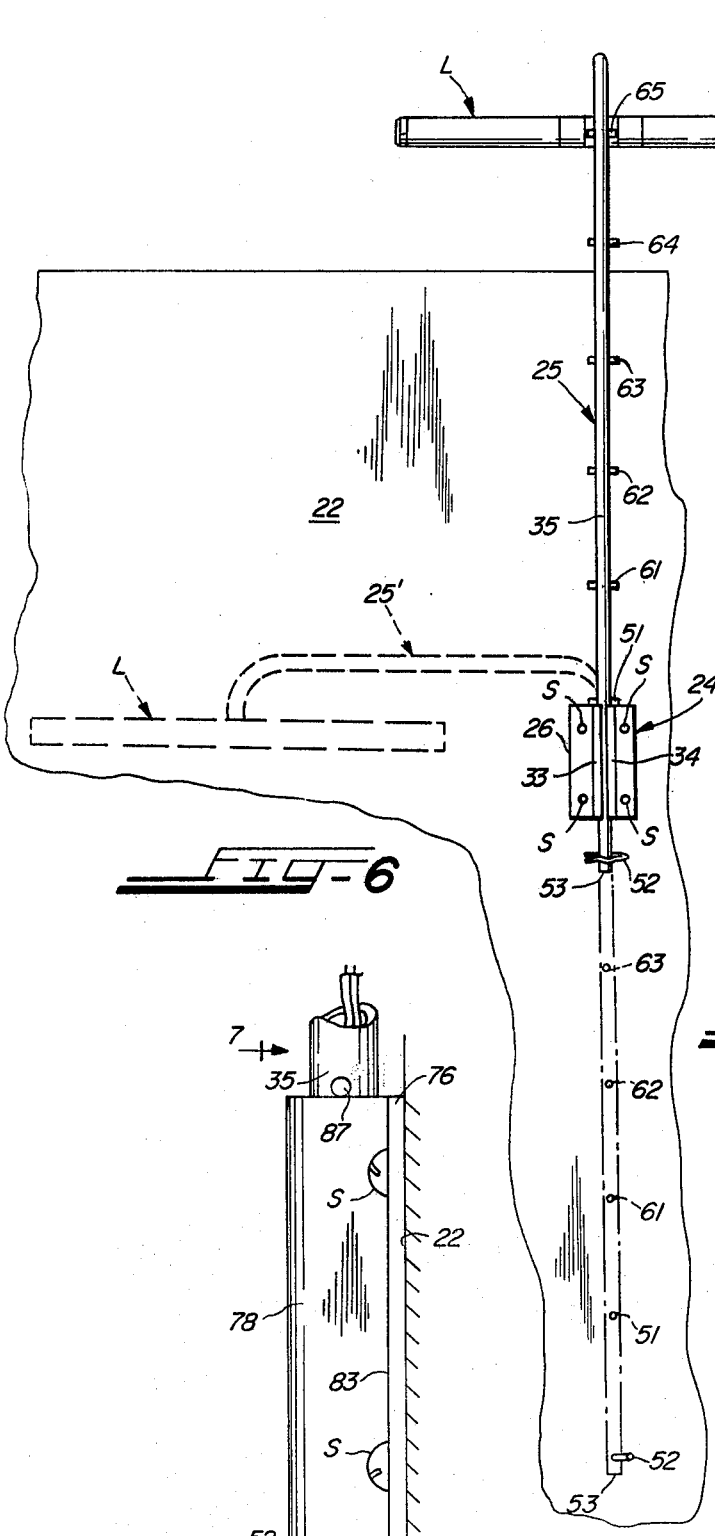
FIG. 1 is a rear elevational view showing, in full lines, the concealable lighting fixture of the present invention as it would appear when mounted on the rear of a piano or the like with the lamp assembly, and its supporting frame, in an elevated, operating position and also showing, in phantom line, the position of the parts of the future when the lamp assembly and frame are in a depressed, concealed position.
Figure 2:
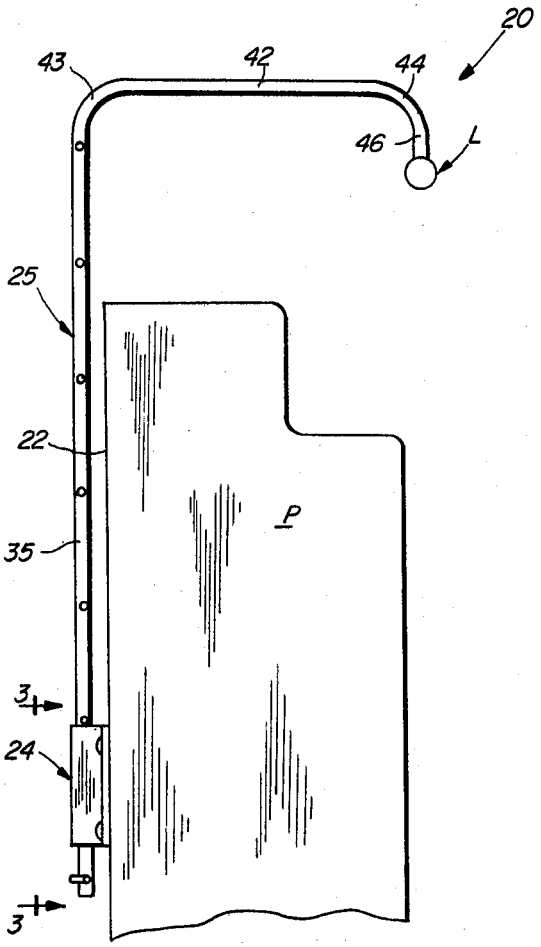
FIG. 2 is a side elevational view of the lighting fixture illustrated in FIG. 1.

In FIGS. 1 and 2, a concealable lighting fixture embodying the features of the present invention is illustrated and indicated generally at 20. The fixture 20, in the present instance, is shown mounted on the rear side, indicated at 22, of a spinet-type piano P that is diagrammatically illustrated in FIGS. 1 and 2. It should be understood, however, that the fixture 20 could also be mounted on other large objects such as an organ, or couch or chair. The fixture 20 may also be mounted on a vertical wall to which the aforementioned large musical instruments or pieces of furniture are closely adjacent, and thus achieve the advantages of the invention, as will be hereinafter described.

The fixture 20 preferably comprises a mounting member in the form of a bracket 24, and an elongated support member in the form of a frame 25 which is carried by the bracket 24 and shiftable therein between an elevated, operative position, shown in full lines in FIGS. 1 and 2, and a depressed, concealed position, shown in broken lines in FIG. 1 and indicated generally at 25'.

Figure 4:
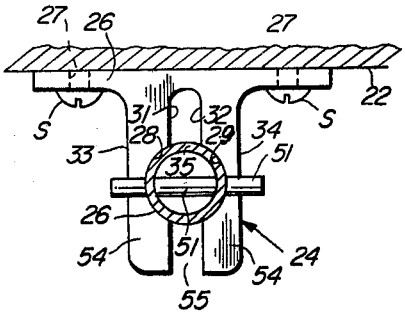
FIG. 4 is a horizontal sectional view taken substantially along the line 4—4 of FIG. 3.
Figure 5:
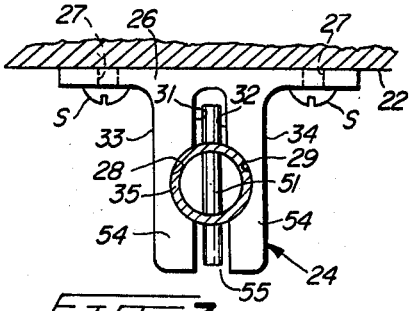
FIG. 5 is a view similar to FIG. 4 but showing the parts of the fixture in different positions.
Figure 3:
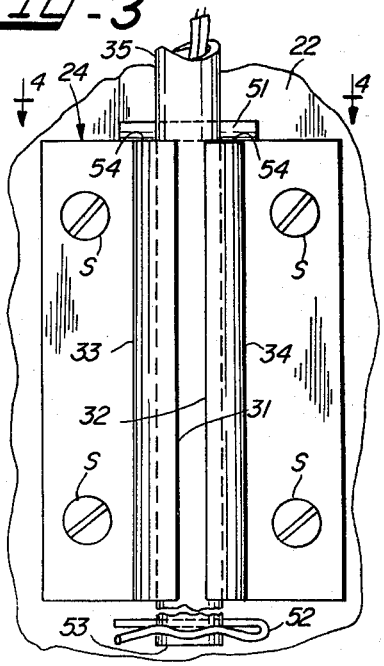
FIG. 3 is an enlarged elevational view of the mounting bracket of the fixture illustrated in FIG. 1 and taken along the line 3—3 of FIG. 2.

Referring now to FIGS. 3–5, inclusive, in conjunction with FIGS. 1 and 2, it will be seen that the bracket 24 comprises a rectangular plate portion 26 having at least one and preferably a plurality of openings 27 therethrough for receiving a plurality of fasteners, such as wood screws S (FIG. 3) for securing the bracket 24 to a vertical surface on the rear side, indicated at 22, of the spinet-type piano P. The bracket 24 also includes bearing means for supporting the frame 25 during movements thereof between its elevated, operative, position illustrated in full lines in FIGS. 1 and 2, and its depressed, concealed position illustrated in broken lines in FIG. 1 and indicated at 25'.

The bearing means of the bracket 24, in the present instance, comprises at least one and preferably a pair of vertically extending, laterally spaced concave recesses 28 and 29 formed in the opposed inner side faces, indicated at 31 and 32, respectively, of a pair of vertically extending, laterally spaced flanges 33 and 34, which extend perpendicularly outwardly from one side of the plate portion 26 of the bracket. The recesses 28 and 29, which comprise bearing portions in the flanges 33 and 34, are adapted to engage and slidably support the elongated, vertically extending portion or leg, indicated at 35, of the frame 25 during movement of the latter between its operative and inoperative positions. To this end, the radius of curvature of the recesses 28 and 29 is preferably substantially equal to that of the exterior of the leg 35, which is circular in cross section, as seen in FIGS. 4 and 5.

While the flanges 33 and 34, and plate portion 26, could be formed in separate pieces and from various materials having suitable bearing and strength properties, they are preferably integral with each other and of nylon.

As best seen in FIGS. 1 and 2, the frame 25 is of an inverted, J-shape and includes the vertically extending portion or leg 35, a horizontally extending section 42 having its proximal end connected to the upper end of the leg 35 by an arcuate portion 43, and its distal end connected by another, arcuate portion 44 to a vertically depending portion or shorter leg, indicated at 46, of the frame. Lamp means in the form of an elongated, horizontally extending lamp assembly, indicated generally at L, is centrally connected to the lower end of the leg 46 for pivotal movement about a vertical axis, as will be described in more detail hereinafter.

According to the present invention, the fixture 20 includes releasable retaining means, carried by the bracket 24 and leg 35 of the frame 25 for holding the frame 25 in its elevated, operative position. Such releasable retaining means comprises a support pin 51 that is preferably mounted in a pair of diametrically arranged bores in the leg 35 of the frame 25. The bores are located in the leg 35 so that the support pin 51 extends substantially horizontally and perpendicular to the horizontally extending section 42 of the frame 25 when mounted in the leg 35. The support pin 51 is vertically spaced above a stop in the form of a hairpin-type clip 52, which is mounted in a pair of diametrically extending bores in the remote lower end, indicated at 53, of the leg 35. The spacing between the pin 51 and clip 52 is preferably somewhat greater than the vertical length of the flanges 33 and 34 of the bracket 24.

With the foregoing construction, when the frame 25 is in its elevated position illustrated in FIGS. 1 and 2 with the horizontally extending section 42 extending perpendicularly to the plate portion 26, the support pin 51 will rest upon the laterally spaced upper surfaces, indicated at 54, of the flanges 33 and 34, in the manner illustrated in FIGS. 1 and 4. Consequently, the leg 35 is prevented from shifting downwardly in the bracket 24. Preferably, the length of the pin 51 is such that it will remain in contact with the upper surfaces 54 throughout at least 45° of angular movement of the horizontally extending section 42 of the frame 25 in either direction from a position perpendicular to the plate portion 26. Thus, when the frame 25 is in its elevated, full line position illustrated in FIGS. 1 and 2, the frame 25 may be rotated about a vertical axis through the leg 35 so that the lamp assembly L thereof shifts on an arc to different positions with respect to the keyboard of the piano P, for example, in order to obtain a desired lighting arrangement.

In addition, since the lamp assembly L is connected to the depending portion 46 of the frame 25 for pivotal movement about a vertical axis through the portion 46, the assembly may also be pivoted about this axis while the frame 25 is pivoting about the vertical axis through the leg 35.

When not in use, the lamp assembly L and frame 25 may be shifted downwardly in the bracket 24 to the depressed, concealed position thereof illustrated in broken lines in FIG. 1 and indicated at 25'. This is easily accomplished by swinging the assembly L and horizontally extending section 42 toward the vertical surface on which the bracket 24 is mounted unitl the support pin 51 moves into alignment with a vertically extending slot, indicated at 55, provided by the gap or space between the inner faces 31 and 32 of the flanges 33 and 34. The width of the slot 55 is thus substantially equal to and preferably somewhat greater than the diameter of the support pin 51. Consequently, the horizontal section 42 of the frame 25 must be swung to a position substantially parallel with the plate portion 26 of the bracket 24 before the pin 51 will be aligned with the slot 55 so that the leg 35 can shift downwardly in the bracket.

Assuming that the horizontally extending section 42 of the frame 25 has been swung sufficiently far toward the left, as viewed in FIG. 1, to bring the pin 51 into alignment with the slot 55, and further assuming that the lamp assembly L has been pivoted to a position parallel to the rear side 22 of the piano P when the horizontally extending section 42 has reached its substantially parallel position to the plate portion 26, the frame 25 may then be lowered to its depressed, concealed position 25' behind the piano P. The frame 25 and lamp assembly L will shift downwardly in the bracket 24 until the arcuate portion 43 of the frame contacts the edge of one or the other of the upper surfaces 54 of the flanges 33 and 34, as illustrated in FIG. 1. The frame 25 may then be released and will thus remain in its depressed, concealed position until it is again desired to use the fixture 20.

According to the present invention, movement of the frame 25 and lamp assembly L between its elevated and depressed positions is facilitated by guide means carried by the leg 35 of the frame 25. Such guide means preferably comprises a plurality of horizontally extending, vertically spaced pins 61–65, inclusive, which are mounted in diametrically extending bores in the leg 35 so that the axes of the pins 61–65 are substantially parallel with the axis of the support pin 51. In addition, the diameters and lengths of the pins 61–65, inclusive, are substantially equal to that of the pin 51 so that the pins 61–65 will freely move downwardly in the slot 55 between the flanges 33 and 34 during raising or lowering of the frame 25. Moreover, the vertical spacing between each adjacent pair of the pins 51, and 61–65, inclusive, is somewhat less than the length of the flanges 33 and 34 so that at least one of the pins will be positioned in the slot 55 as the frame 25 is shifted between its fully elevated position illustrated in FIGS. 1 and 2 and its fully depressed, concealed position 25' illustrated in broken lines in FIG. 1.

It should be understood, however, that while the aforementioned guide means is preferably provided by the pins 61–65, inclusive, other equivalent structures could be utilized for this purpose. For example, a plurality of vertically spaced, outwardly extending lugs could be provided on the outer surface of the leg 35, or one or a pair of diametrically arranged, axially extending splines could also be employed.

Figure 6:
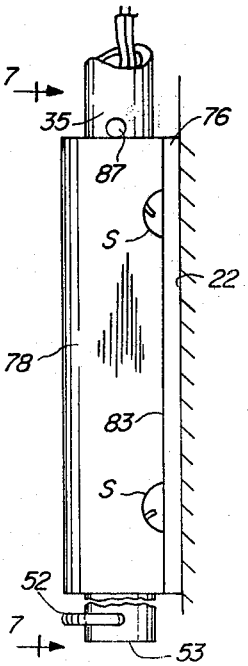
FIG. 6 is a side elevational view showing an alternate construction of the mounting bracket of the fixture.
Figure 8:
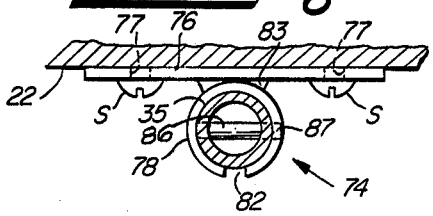
FIG. 8 is a horizontal sectional view taken along the line 8—8 of FIG. 7.
Figure 7:
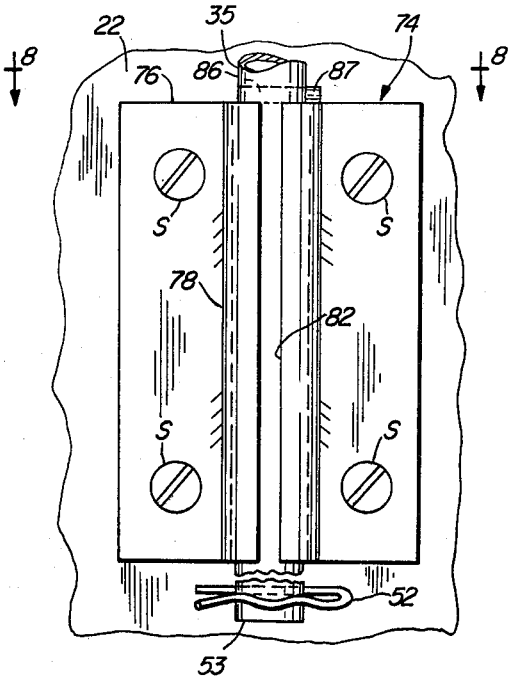
FIG. 7 is an elevational view taken substantially along the line 7—7 of FIG. 6.

Referring now to FIGS. 6, 7 and 8, an alternate bracket construction, indicated generally at 74, is illustrated. The bracket 74 is similar to the bracket 24 in that the bracket 74 includes a rectangular plate portion 76 having a plurality of openings 77 therethrough to facilitate mounting of the bracket on a vertical surface, such as the rear side 22 of the piano P, as by wood screws S.

The bracket 74 differs from the bracket 24 in that the bearing means for shiftably and rotatably supporting the leg 35 of the frame 25 during movements thereof between its raised, operative position and its despressed, concealed position is provided by a tube 78, which is split throughout its length to define a slot 82 therein. The tube 78 is preferably secured as by welding, indicated at 83, to one side of the plate portion 76 so that the slot 82 in the tube 78 is disposed diametrically oppositely from the side of the tube that is welded to the plate portion 76.

The inside diameter of the tube 78 is substantially equal to the outside diameter of the leg 35 of the frame 25 so that the leg 35 is supported by and freely axially shiftable in the tube 78.

Since the tube 78 is welded to one side of the plate portion 76, a support pin 86, that is substantially shorter than the support pin 51, is mounted in diametrically extending bores in the tube 35 and so that only one end, indicated at 87, of the pin 86 projects outwardly from the leg 35 of the frame 25 and engages the upper end, indicated at 79, of the tube 87. The end 79 thus comprises a support surface on the bracket 74, and the support surface 74, together with the projecting end 87 of the pin 86, comprise releasable retaining means for releasably retaining the frame 25 and lamp assembly L in an elongated, operative position. The axial length of the projecting end 87 of the support pin 86 is preferably somewhat less than the outside diameter of the tube 78 to permit the end 87 to clear the welding 83 and adjacent surface of the plate portion 76 as the leg 35 rotates in the tube 78 during swing movement of the frame 25.

Since only the slot 82 in the tube 78 is available to accommodate vertical movement of the projecting end 87 of the pin 86, it will be apparent that when the bracket construction 74 is employed in the light fixture 20, the frame 25 can be raised and lowered between its elevated operative position and its depressed, concealed position only when the horizontally extending section 42 of the frame is swung in one direction from its operative, perpendicular position with respect to the plate portion 76 to its parallel position to the plate portion 76 when it is desired to raise or lower the frame 25. Specifically, when the plate portion 76 of the bracket 74 is secured to the rear side of a large musical instrument or article of furniture, or to a vertical wall adjacent to such an item, the frame 25 must be rotated in a clockwise direction when the horizontally extending section 42 of the frame is extending forwardly over the instrument, as illustrated in FIGS. 1 and 2. In other words, when facing the lamp assembly L, a user must swing the horizontally extending section 42 toward the left until the section is substantially parallel to the plate portion 76 in order to lower the frame 25 in the bracket 24. However, if the pin 86 were mounted in the frame portion 35 so that the end 87 thereof is projected outwardly from the left side of the vertically extending frame portion, as viewed in FIGS. 7 and 8, a user would have to swing the horizontally extending section 42 toward the right, when facing the lamp assembly L, in order to lower the frame 25.

Since the tube 78 of the bracket 74 either touches or is closely adjacent to the plate portion 76 when the bracket is fabricated, it is preferable that shorter length guide pins (not shown) be inserted in the vertically shaped, diametrically extending openings in the leg 35 above the support pin 86 instead of the pins 61–65, inclusive, and so that the left ends of the pins are flush with the exterior of the leg 35, in the same manner as the pin 86.

Figure 9:
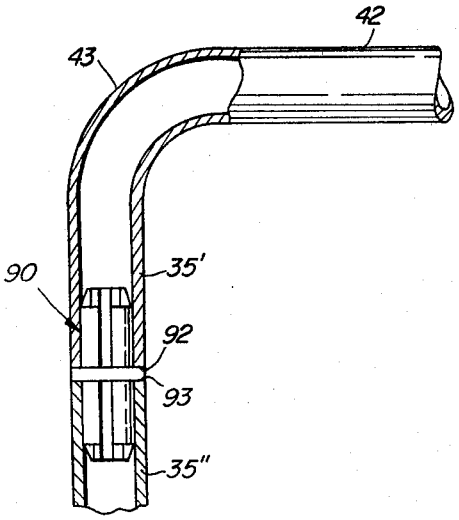
FIG. 9 is a fragmentary side elevational view, with some parts in section, showing an alternate construction of the lamp support portion of the fixture.

In order to reduce the size of the box or carton in which the fixture 20 is packaged for shipment or storage, the frame 25 thereof may be made in two pieces. To this end, the longer leg 35 thereof may be severed adjacent to the arcuate portion or bend 43, as illustrated in FIG. 9, and an appropriate tubular connector 90, may be inserted into the adjoining ends, indicated at 92 and 93, of the upper end lower portions, indicated at 35' and 35'' of the leg 35 to join these pieces. Other equivalent structures could be used to join the frame portions 35' and 35'', instead of the connector 90.

Figures 10, 11, 12, 13:
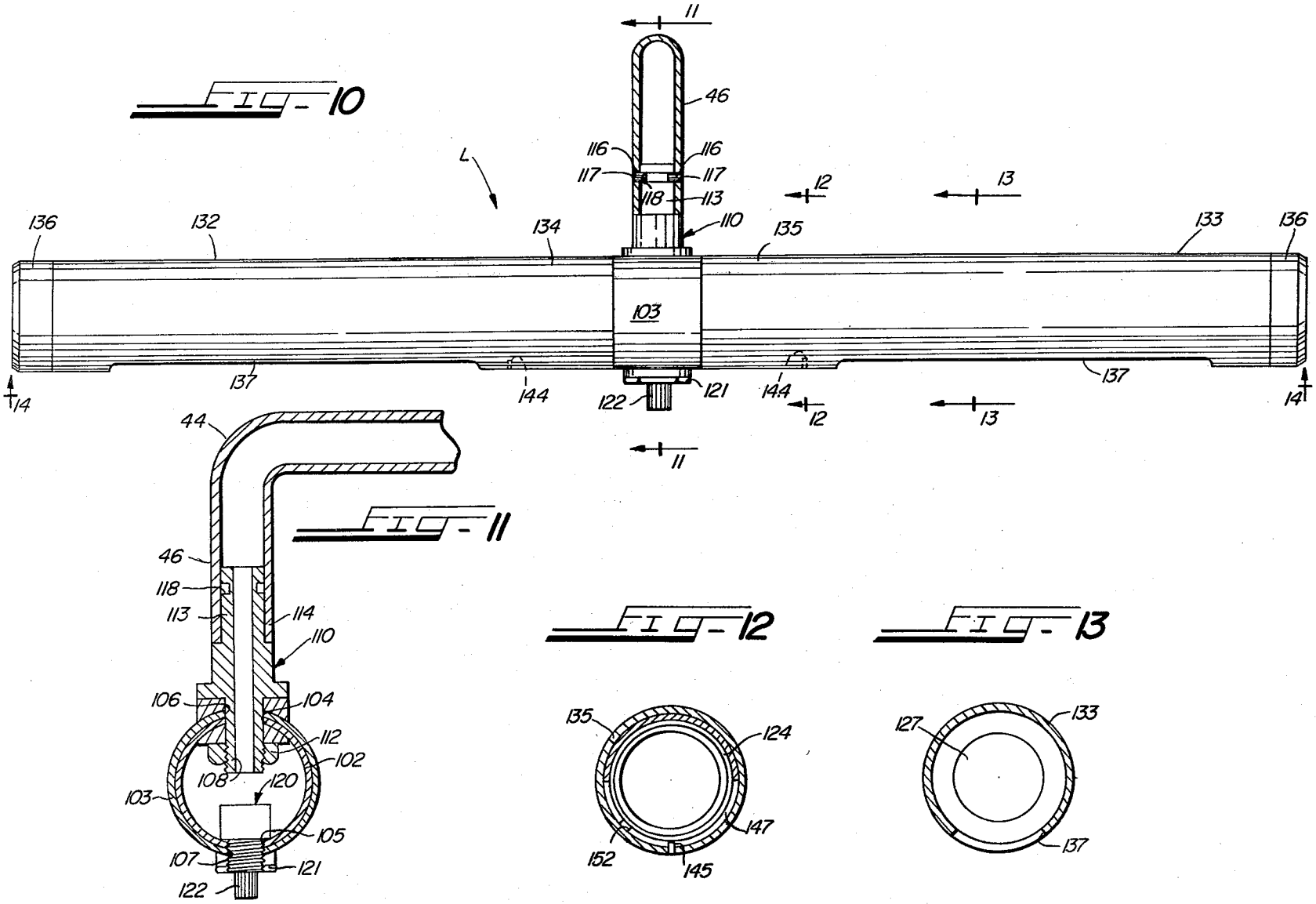
FIG. 10 is a front elevational view, with some parts in section, of the lamp assembly of the fixture.
FIGS. 11, 12 and 13 are a series of vertical sectional views taken along the lines 11—11, 12—12 and 13—13, respectively, of FIG. 10.
Figure 14:
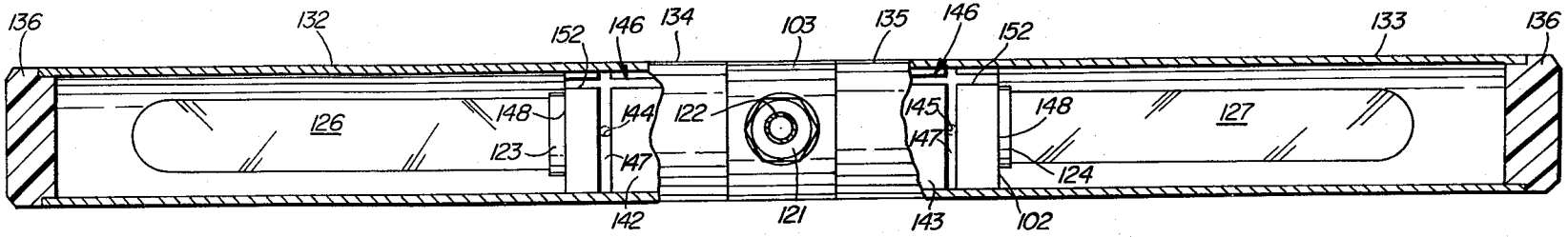
FIG. 14 is a bottom plan view, with some parts in section and with others broken away to show underlying details, of the lamp assembly of the fixture and taken substantially along the line 14—14 of FIG. 10.

Referring now to FIGS. 10–14, inclusive, in conjunction with FIGS. 1 and 2, the construction of the lamp means or lamp assembly L of the fixture 20 will now be described. As best seen in FIGS. 10, 11 and 14, the lamp assembly L comprises a tubular shade support member 102, which is enclosed by a sleeve 103, the shade support member 102 and sleeve 103 having diametrically spaced, vertically extending bores 104,105 and 106,107, respectively, therethrough. The lower shaft portion, indicated at 108 of a fitting 110 extends through the bores 104 and 106 and is secured thereto by a nut 112. The upper shaft portion, indicated at 113, of the fitting 110 extends into the lower end, indicated at 114, of the shorter leg 46 of the frame 25 and is retained in the end 114 by at least one and preferably a pair of diametrically extending pins 116 (FIG. 10), which are pressed into diametrically arranged openings 117 in the leg 46. The inner ends of the pins 116 extend into an annular groove 118 in the shaft portion 113 of the fitting 110 so that the fitting, and consequently the shade supporting member 102 and sleeve 103 can rotate relative to the leg 46. An electrical switch 120 is mounted in the bores 105,107 and retained therein by a nut 121, the actuating button indicated at 122, extending downwardly from the sleeve 103, as shown in FIGS. 10 and 11.

As best seen in FIGS. 12 and 14, a pair of electrical sockets 123 and 124 are mounted in the outer ends of the support member 102, the sockets 123 and 124 being adapted to receive the contact ends (not shown) of a pair of light emitting elements, in the present instance, elongated, incandescent bulbs 126 and 127, respectively. While the lamp assembly L preferably utilizes incandescent type bulbs, it will be understood that other types of light emitting elements, such as fluorescent tubes, could be used in place of the bulbs 126 and 127.

The lamp assembly L also includes a pair of elongated, tubular shades 132 and 133 of the same inside and outside diameters as the sleeve 103 so that the shades form continuations of the sleeve when the inner ends, indicated at 134, of the shades 132 and 133 are engaged with the sleeve 103, as illustrated in FIGS. 10 and 14. The outer ends of the shades 132 and 133 are closed by plugs 136 which are preferably of a material of low heat conductivity so as to facilitate manipulation of the shades 132 and 133 to different rotated positions on the support member 102 to direct the light from the bulbs 126 and 127 in different directions. Thus, the plugs or caps 136 are preferably of polycarbonate or acrylic plastic and are pressed into the open, outer ends of the shades 132 and 133.

The shades 132 and 133 are preferably of an opaque material, such as steel, brass or aluminum, and each includes an elongated opening or aperture 137 (FIGS. 10 and 13) in the wall thereof so that the light from the bulbs 126 and 127 may be directed to a desired location by the user by adjusting the shades.

According to the present invention, the lamp assembly L includes releasable locking means for releasably retaining the shades 132 and 133 engaged with the outer end portions, indicated at 142 and 143, respectively, of the shade support member 102 until it becomes necessary to remove the shades for purposes of inspection, cleaning or replacement of the bulbs 126 and 127. Such releasable locking means preferably comprises a pair of pins 144 and 145 (FIGS. 10, 12 and 14), which are respectively mounted in diametrically extending openings in the inner end portions 134 and 135 of the shades 132 and 133 and which are of a length such that the inner ends of the pins 144 and 145 project slightly into the interior of the shades when the outer ends of the pins 144 and 145 are flush with the outer surfaces thereof. The releasable locking means also includes slot means, indicated generally at 146, in the end portions 142 and 143 of the support member 102 for receiving the inner ends of the pins 144 and 145.

Each slot means 146 has a circumferentially extending portion 147, spaced axially inwardly from the adjacent outer end, indicated at 148, of the support member 102, and a portion 152, which extends axially inwardly from the outer end 148 so as to intersect the circumferentially extending portions 147. As best seen in FIG. 12, each circumferentially extending portion 147 extends for approximately 180° of the circumference of the support member 102 and each axially extending portion 152 is disposed approximately 45° between the midpoint of the circumferentially extending portion 147 and the end thereof that is disposed toward the user when the fixture 20 is in its operative position.

With the foregoing construction, it will be apparent that either of the shades 132 or 133 may be easily removed from their engaged positions with the end portions 142 and 143 of the support member 102 merely by rotating the shades until the pins 144 and 145 are in axial alignment with the axially extending portions 152 of the slot means 146, and then shifting the shades axially outwardly until the shades are disengaged from the support member. After the shades 132 and 133 have been removed, the bulbs 126 and 127 are accessible for inspection, cleaning and/or replacement. The shades are easily reinstalled by aligning the inner ends of the pins 144 and 145 with the axial portions 152 of the slot means 146, and then shifting the shades inwardly onto the end portions 142 and 143 until the inner ends of the shades engage the ends of the sleeve 103. The shades may then be rotated in either direction by an amount sufficient to cause the inner ends of the pins 144 and 145 to move into the circumferentially extending portions 147 of the slot means 146, at which time the shades are again locked to the support member 102.

Figure 15:
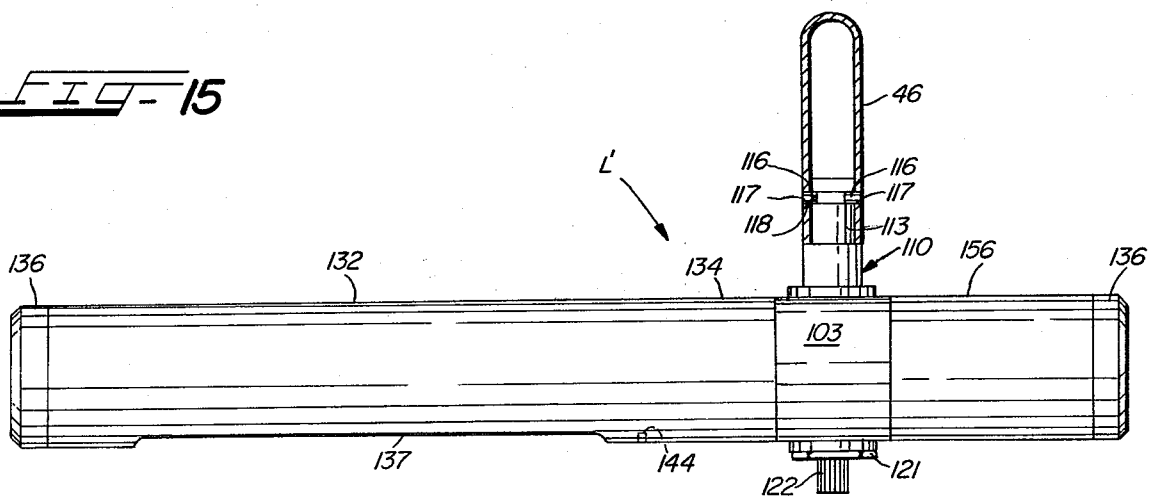
FIG. 15 is a front elevational view, with some parts in section, of the lamp assembly portion of another concealable lighting fixture embodying the features of the present invention.

In FIG. 15, an alternate lamp assembly construction is ilustrated and indicated generally at L'. Like reference numerals have been used to identify parts of the lamp assembly L' identical with those of the lamp assembly L. The lamp means L' differs from the lamp means L in that only one bulb receiving socket (not shown) is mounted in the support member (also not shown) for receiving and supporting only one light emitting element, such as the incandescent bulb 126. The lamp assembly L' likewise includes only one shade, such as the shade 132, for controlling the direction in which light is emitted from the bulb 126. Since the lamp assembly L' employs only one bulb and one shade, a spacer sleeve 156 is mounted on the unused end portion 143 of the support member 102, the outer end of the sleeve 156 being closed by a plug such as a plug 136.

The lamp assembly L' is the same as the lamp assembly L in that assembly L' also includes releasable locking means for releasably retaining the shade 132 engaged with the outer end portion 142 of the shade support member. Such releasable locking means is identical with that employed to releasably retain the shade 132 of the lamp assembly L engaged with the end portion 142 of this embodiment. Accordingly, reference should be made in this specification to the description of the releasable locking means of the lamp assembly L for an understanding of the construction and operation of the releasably locking means of the lamp assembly L'. The manner in which the lamp assembly L' is engaged with and rotatable with respect to the shorter leg 46 of the frame 25 is likewise the same as that of assembly L. The lamp assembly L' is, in all other respects, identical with that of the lamp means L.

While one or more embodiments of the invention have been herein illustrated and described, it will be understood that modifications and variations thereof may be developed which do not depart from the spirit of the invention and the scope of the appended claims.

We claim:

1. A concealable lighting fixture comprising a mounting member adapted to be mounted on a vertical surface, such as the hidden side of a large object capable of concealing the fixture, or on a wall adjacent to such an object, bearing means carried by said mounting member, a support member mounted in said bearing means for movement between an elevated, operative position and a depressed, position concealed by said object, said support member having upper and lower ends, lamp means carried at said upper end of said support member, and releasable retaining means carried by said bearing means and said support member for retaining said support member in said elevated, operative position while permitting said support member and said lamp means to be swung through a range of angular positions about a vertical axis through said bearing means, said releasable retaining means also being operable when said support member is disposed in a predetermined angular position with respect to said bearing means to permit said support member to be shifted downwardly from said elevated position to said depressed, concealed position.

2. The concealable lighting fixture of claim 1, in which said support member comprises a frame having an elongated, vertically extending portion slidably mounted in said bearing means, said support member also includes a horizontally extending section having a proximal end connected to the upper end of said vertically extending portion and a distal end remote from said vertically extending portion, and said lamp means is carried at said distal end of said horizontally extending section.

3. The concealable lighting fixture of claim 2, in which said frame is generally in the shape of an inverted letter J.

4. The concealable lighting fixture of claim 2, in which the distal end of said horizontally extending section includes a vertically extending depending portion, and said lamp means is carried at the lower end of said depending portion.

5. The concealable lighting fixture of claim 4, in which said lamp means is mounted for pivotal movement about a vertical axis through said depending portion.

6. The concealable lighting fixture of claim 1, in which said mounting member includes a plate portion adapted to be secured to said vertical surface, and said bearing means is carried on one side of said plate portion.

7. The concealable lighting fixture of claim 6, in which said support member has an elongated, vertically extending portion, the exterior of said vertically extending portion is cylindrical, and said bearing means includes at least one concave bearing portion engaged with at least a portion of the cylindrical exterior of said vertically extending portion and slidably supporting the same in said bearing means.

8. The concealable lighting fixture of claim 7, in which said bearing means includes an oppositely arranged pair of said concave bearing portions engaged with diametrically spaced portions of the exterior of said vertically extending portion.

9. The concealable lighting fixture of claim 8, in which said bearing means comprises a pair of laterally spaced vertically extending flanges carried by said plate portion and having opposed inner side faces, and said bearing portions comprise a pair of concave recesses in the inner faces of said flanges.

10. The concealable lighting fixture of claim 9, in which said flanges are integral with said plate portion.

11. The concealable lighting fixture of claim 10, in which said flanges and said plate portion are of nylon.

12. The concealable lighting fixture of claim 6, in which said bearing means comprises a tube secured to said plate portion and having a substantially cylindrical interior, the interior of said tube comprising a bearing portion for slidably supporting said vertically extending portion.

13. The concealable lighting fixture of claim 1, in which said support member has an elongated vertically extending portion, said bearing means has upper and lower ends, the upper end of said bearing means has a horizontal support surface, said releasable retaining means includes an abutment on the outer surface of said vertically extending portion, and said abutment rests on said horizontal support surface of said bearing means when said support member is in said elevated position.

14. The concealable lighting fixture of claim 13, in which said abutment comprises at least one horizontally extending support pin mounted in said vertically extending portion and having at least one end thereof projecting outwardly from the outer surface of said vertically extending portion, and said projecting end of said support pin rests on said horizontal support surface of said bearing means when said support member is in said elevated position.

15. The concealable lighting fixture of claim 14, in which said bearing means comprises a pair of laterally spaced, vertically extending flanges on one side of said plate portions, said elongated vertically extending portion is disposed between and slidably supported by said flanges, the upper ends of said flanges comprise a laterally spaced pair of said horizontal support surfaces, and the ends of said support pin project outwardly from the outer surface of said vertically extending portion and respectively rest on the laterally spaced horizontal support surfaces of said flanges.

16. The concealable lighting fixture of claim 14, in which the space between said flanges comprises a vertically extending slot in said bearing means, the width of said slot is at least equal to the diameter of said support pin, said slot extends perpendicularly to said plate portion, and the ends of said support pin are aligned with said slot when said support member is disposed in said predetermined angular position.

17. The concealable lighting fixture of claim 16, in which said vertically extending portion of said support member includes guide means coacting with said slot to prevent rotation of said vertically extending portion as said support member is shifted between its elevated and depressed positions.

18. The concealable lighting fixture of claim 17, in which said guide means comprises a plurality of horizontally extending pins mounted in vertically spaced relation in said vertically extending portion above said support pin, the outwardly projecting ends of each of said guide pins being in vertical alignment with the ends of said support pin, and the vertical spacing between each adjacent pair of said guide pins being less than the length of said slot.

19. The concealable lighting fixture of claim 14, in which said bearing means comprises a tube secured to said plate portion and having a substantially cylindrical interior comprising a bearing portion for slidably supporting said vertically extending portion, and said tube is split throughout its length to define a vertically extending slot therein, said slot accommodating passage of said abutment therethrough as said vertically extending portion of said support member is shifted between its elevated and depressed positions.

20. The concealable lighting fixture of claim 1, in which the upper end of said support member has a shade support member adapted to receive and support a shade for enclosing a light emitting element, releasable locking means is carried by said shade support member and said shade for retaining said shade in engaged relation with said shade support member, said releasable locking means permits said shade to be shifted to an operative, engaged position with said shade support member and also permits said shade to be shifted to an inoperative position disengaged from said shade support member only when said shade is in a predetermined position relative to said shade support member.

21. The concealable lighting fixture of claim 20, in which one end of said shade is tubular, said shade support member is also tubular and adapted to extend into said one end of said shade for supporting the same, and said releasable locking means comprises a slot means in said shade support member and a pin mounted in said one end of said shade and having a portion extending into said slot means.

22. The concealable lighting fixture of claim 21, in which said shade support member has an axially outer end, said slot means includes a circumferentially extending portion spaced inwardly from the outer end of said shade support member and an axially extending portion extending inwardly from the outer end of said shade support member and intersecting said circumferentially extending portion, whereby said shade can be engaged with and disengaged from said shade support member by shifting said shade axially with respect to said support member when said pin is aligned with the axially extending portion of said slot means.

23. The concealable lighting fixture of claim 22, in which said shade is substantially opaque and has an aperture therein for directing the light from said light emitting element in different directions, and the circumferentially extending portion of said slot means is of a length such as will permit said shade to be rotated to different positions relative to said shade support member in order to control the direction in which light shines from said light emitting element.

24. The concealable lighting fixture of claim 20, 21, 22 or 23, in which said shade support member has opposite ends, and releasable locking means is carried at each end of said shade support member for releasably retaining a pair of said shades in end-to-end, engaged relation with said shade support member.

25. A concealable lighting fixture comprising a mounting member adapted to be mounted on a vertical surface, such as the hidden side of a large object capable of concealing the fixture, or on a wall adjacent to such an object, bearing means carried by said mounting member, a support member mounted in said bearing means for movement between an elevated, operative position and a depressed position concealed by said object, said support member having upper and lower ends, lamp means carried at said upper end of said support member, said lamp means including a tubular shade support member carried at said upper end of said support member and at least one shade having a tubular end engaged with said shade support member, said lamp means also including releasable locking means for retaining said shade in engaged relation with said shade support member, said releasable locking means permitting said shade to be shifted to an operative engaged position with said shade support member and also permitting said shade to be shifted to an inoperative position disengaged from said shade support member only when said shade is in a predetermined position relative to said shade support member, and releasable retaining means carried by said bearing means and said support member for retaining said support member in said elevated, operative position while permitting said support member and said lamp means to be swung through a range of angular positions about a vertical axis through said bearing means, said releasable retaining means also being operable when said support member is disposed in a predetermined angular position with respect to said bearing means to permit said support member to be shifted downwardly from said elevated position to said depressed, concealed position.

* * * * *